US006274990B1

(12) United States Patent
Hojo et al.

(10) Patent No.: US 6,274,990 B1
(45) Date of Patent: Aug. 14, 2001

(54) DEVICE AND METHOD FOR CORRECTING LANDING POSITION IN COLOR CATHODE RAY TUBE

(75) Inventors: Minoru Hojo; Takeo Kawaguchi, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/459,539

(22) Filed: Dec. 13, 1999

(30) Foreign Application Priority Data

Jan. 12, 1999 (JP) ..... 11-005228

(51) Int. Cl.[7] ..... H01J 29/56
(52) U.S. Cl. ..... 315/401; 315/370
(58) Field of Search ..... 315/401, 370, 315/8, 85; 348/806, 745

(56) References Cited

U.S. PATENT DOCUMENTS 5,559,565 * 9/1996 Yun ..... 348/806
5,583,401 * 12/1996 Inoue et al. ..... 315/370
6,077,458 * 6/2000 Shiiki et al. ..... 252/301.4

FOREIGN PATENT DOCUMENTS 591521 4/1993 (JP) .
5236517 9/1993 (JP) .

* cited by examiner

*Primary Examiner*—Don Wong
*Assistant Examiner*—James Clinger

(57) ABSTRACT

A device for correcting a landing position of an electron beam in a color cathode ray tube has a funnel temperature sensor, an ambient temperature sensor, a landing correction coil disposed on or around a corner of the outer surface of the color cathode ray tube, and a processor and controller for calculating a first temperature difference between the temperature of the funnel and the ambient temperature and a second temperature difference between a predetermined design temperature and the ambient temperature, and calculating a current value for the landing correction coil according to the first and second temperature differences to supply a current of the obtained current value to the landing correction coil.

15 Claims, 6 Drawing Sheets

DEVICE AND METHOD FOR CORRECTING LANDING POSITION IN COLOR CATHODE RAY TUBE

BACKGROUND OF THE INVENTION

The present invention relates to a device and a method for correcting a landing position of an electron beam in a color cathode ray tube.

FIG. 8 is a diagram showing a plan view of a conventional color cathode ray tube. As shown in FIG. 8, a glass bulb 20 forming an envelope of the color cathode ray tube is mainly composed of a glass panel 1, a funnel 2, and a neck 21. Three electron beams emitted from an electron gun 3 incorporated in the neck 21 are deflected up and down and from side to side by a deflection yoke 4. The three deflected electron beams individually pass a color selection member 5 such as a shadow mask and hit predetermined positions (red, green, and blue phosphor areas) on a fluorescent screen 6 formed on an inner surface of the glass panel 1. The fluorescent screen 6 is scanned up and down and from side to side with the electron beams to display a color image.

When the electron beams pass the aperture of the color selection member 5, about 80% of the beams strike the color selection member 5, resulting in a thermal expansion of the color selection member 5. The thermal expansion of the color selection member 5, however, causes the electron beams, which have passed the aperture of the color selection member 5, to hit positions differing from the predetermined positions on the fluorescent screen 6, changing the landing positions. A change in an ambient temperature also causes the glass panel 1 to expand or shrink, changing the landing position likewise. While the color cathode ray tube is operating, the temperature of the funnel 2 also varies. This affects heat radiation of the color selection member 5, changing the amount of thermal expansion of the color selection member 5.

In the color cathode ray tube, the thermal expansion of the color selection member 5 results in a temperature drift (a positional drift of the landing position resulting from a temperature change of the color selection member 5), as described above. In addition, a change in the ambient temperature causes the glass panel 1 to expand or shrink, resulting in an environment drift (a positional drift of the landing position resulting from a temperature change of the environment). Conventional methods for correcting the above-mentioned landing position changes (drift) include a method for correcting the courses of electron beams according to changes in the ambient temperature and another method for correcting the courses of electron beams according to the brightness of the image.

The former method, however, cannot correct an extreme landing deviation as large as a single pitch, for instance. The latter method cannot improve correction accuracy because of thermal variation of the color cathode ray tube itself and the like.

SUMMARY OF THE INVENTION

It is an object of the present invention to provide a device and a method for correcting a landing position in a color cathode ray tube, which enables highly accurate correction and can correct extreme landing deviations.

According to an aspect of the present invention, a device for correcting a landing position of an electron beam in a color cathode ray tube, comprises: a funnel temperature sensor for detecting a temperature of a funnel of the color cathode ray tube; an ambient temperature sensor for detecting an ambient temperature around the color cathode ray tube; a landing correction coil disposed on or around a corner of an outer surface of the color cathode ray tube; and a controlling section for calculating a first temperature difference between the temperature of the funnel and the ambient temperature and a second temperature difference between a predetermined design temperature and the ambient temperature, calculating a current value for the landing correction coil according to the first and second temperature differences, and supplying a current of the obtained current value to the landing correction coil.

According to another aspect of the present invention, a device for correcting a landing position of an electron beam in a color cathode ray tube, comprises: first to fourth funnel temperature sensors for detecting first to fourth temperatures of first to fourth corners of an outer surface of the color cathode ray tube, respectively; an ambient temperature sensor for detecting an ambient temperature around the color cathode ray tube; first to fourth landing correction coils disposed on or around the first to fourth corners of the outer surface of the color cathode ray tube, respectively; a controlling section for calculating first to fourth temperature differences between the first to fourth temperatures and the ambient temperature, calculating a fifth temperature difference between a predetermined design temperature and the ambient temperature, calculating a first current value for the first landing correction coil according to the first and fifth temperature differences, calculating a second current value for the second landing correction coil according to the second and fifth temperature differences, calculating a third current value for the third landing correction coil according to the third and fifth temperature differences, calculating a fourth current value for the fourth landing correction coil according to the fourth and fifth temperature differences, and supplying first to fourth currents of the obtained first to fourth current values to the first to fourth landing correction coils, respectively.

According to a further aspect of the present invention, a method for correcting a landing position of an electron beam in a color cathode ray tube, comprises the steps of: detecting a temperature of a funnel of the color cathode ray tube; detecting an ambient temperature around the color cathode ray tube; calculating a first temperature difference between the temperature of the funnel and the ambient temperature; calculating a second temperature difference between a predetermined design temperature and the ambient temperature; calculating a current value for a landing correction coil disposed on or around a corner of an outer surface of the color cathode ray tube according to the first and second temperature differences; and supplying a current of the obtained current value to the landing correction coil.

According to a further aspect of the present invention, a method for correcting a landing position of an electron beam in a color cathode ray tube, comprises the steps of: detecting a temperature of a funnel of the color cathode ray tube; detecting an ambient temperature around the color cathode ray tube; calculating a first temperature difference between the temperature of the funnel and the ambient temperature; calculating a second temperature difference between a predetermined design temperature and the ambient temperature; calculating four current values for four landing correction coils each disposed on or around corners of an outer surface of the color cathode ray tube according to the first and second temperature differences; and supplying currents of the obtained current values to the four landing correction coils, respectively.

According to a further aspect of the present invention, a method for correcting a landing position of an electron beam in a color cathode ray tube, comprises the steps of: detecting first to fourth temperatures of first to fourth corners of an outer surface of the color cathode ray tube; detecting an ambient temperature around the color cathode ray tube; calculating first to fourth temperature differences between the first to fourth temperatures and the ambient temperature; calculating a fifth temperature difference between a predetermined design temperature and the ambient temperature; calculating a first current value for a first landing correction coil disposed on or around the first corner according to the first and fifth temperature differences, a second current value for a second landing correction coil disposed on or around the second corner according to the second and fifth temperature differences, a third current value for a third landing correction coil disposed on or around the third corner according to the third and fifth temperature differences, and a fourth current value for fourth landing correction coil disposed on or around the fourth corner according to the fourth and fifth temperature differences; and supplying first to fourth currents of the obtained current values to the first to fourth landing correction coils, respectively.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1A:
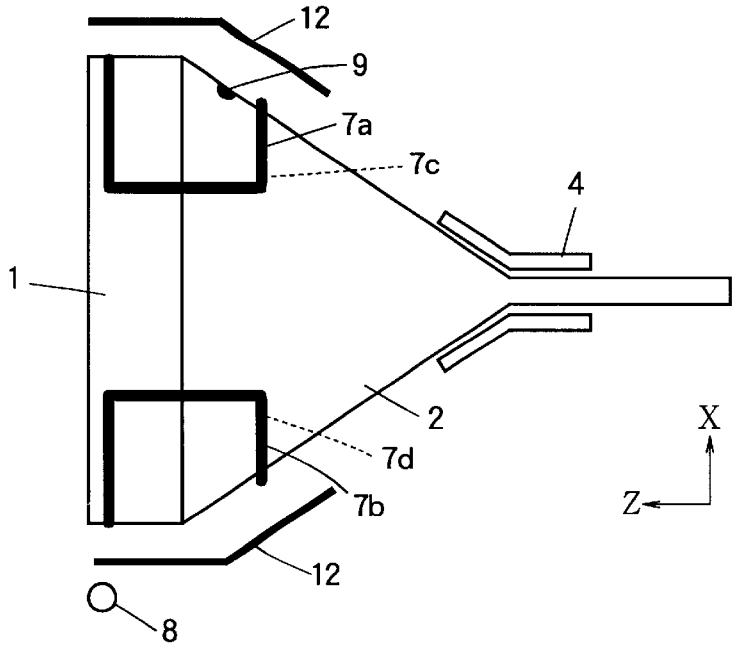
FIG. 1A is a diagram showing a plan view of a color cathode ray tube provided with a device for correcting a landing position according to a first embodiment of the present invention.
Figure 1B:
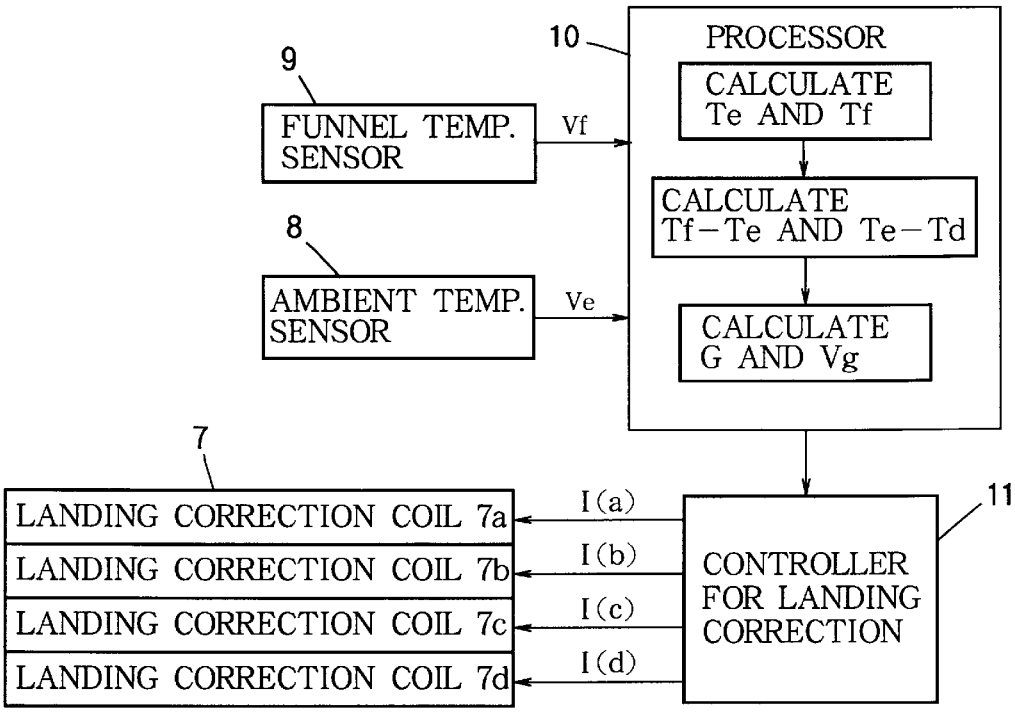
FIG. 1B is a block diagram showing the configuration of the device of the first embodiment.
Figure 7:
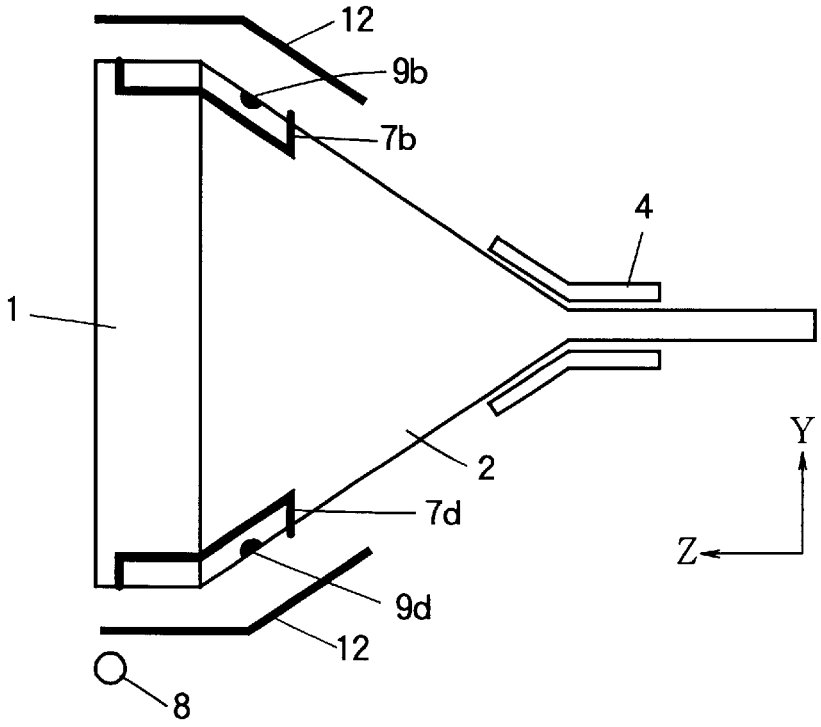
FIG. 7 is a diagram showing the mounting position of the ambient temperature sensor in a color cathode ray tube according to a fifth embodiment of the present invention.
Figure 8:
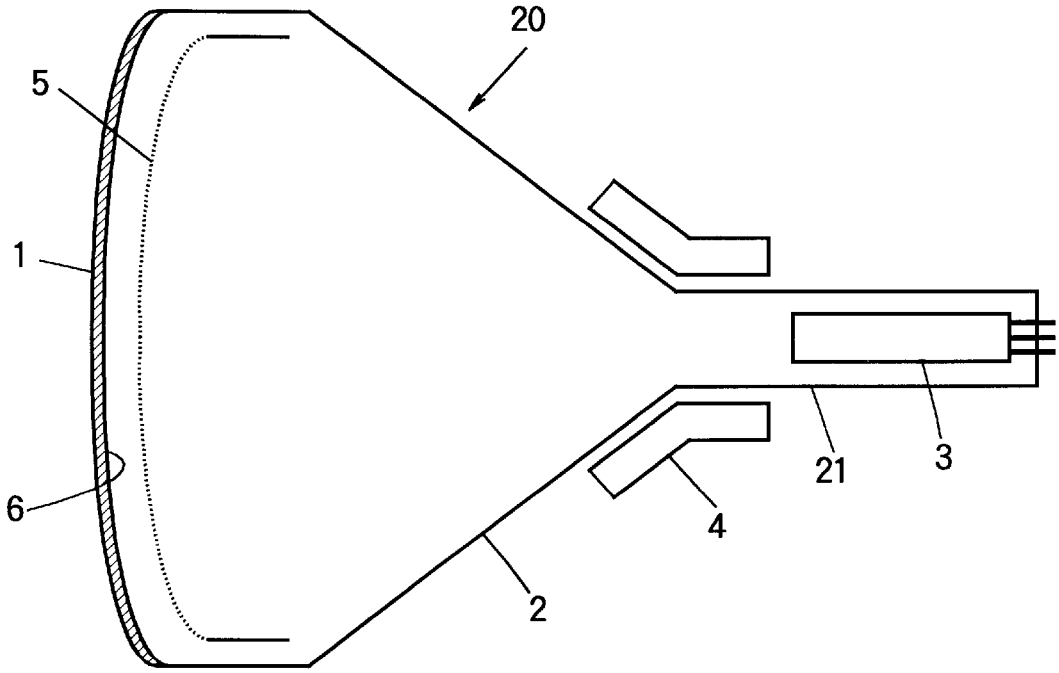
FIG.8 PRIOR ART
FIG. 8 is a diagram showing the structure of the conventional color cathode ray tube.

FIG. 1A is a diagram showing a plan view of a color cathode ray tube provided with a device for correcting a landing position of an electron beam according to a first embodiment of the present invention. FIG. 1B is a block diagram showing the configuration of the device for correcting a landing position. As shown in FIGS. 1A and 1B, the device of the first embodiment includes a landing correction mechanism 7 (or 7*a*, 7*b*, 7*c*, 7*d*) such as a landing correction coil, an ambient temperature sensor 8 for detecting an ambient temperature, a funnel temperature sensor 9 for detecting a temperature of the funnel 2, a processor 10, a landing correction mechanism controller. In FIG. 1A, a reference numeral 12 denotes an external magnetic shield provided in a monitor set in which the color cathode ray tube is mounted. In FIGS. 1A and 1B, the same reference numerals are used to denote the same parts as shown in FIG. 7 (Fifth Embodiment).

The ambient temperature sensor 8 is provided in or outside the monitor set containing the color cathode ray tube (disposed outside the color cathode ray tube). The ambient temperature sensor 8 is a thermoelectric conversion element that outputs the voltage (ambient temperature detection voltage) Ve according to the ambient temperature Te around the color cathode ray tube. The funnel temperature sensor 9 is provided on the funnel 2 of the color cathode ray tube. The funnel temperature sensor 9 is a thermoelectric conversion element that outputs the voltage (funnel temperature detection voltage) Vf according to the temperature of the funnel 2 (funnel temperature) Tf.

A single landing correction mechanism 7 (or 7*a*, 7*b*, 7*c*, and 7*d*) is provided in each of the four corners of an outer surface (for example, from a top surface to a side surface) of the color cathode ray tube, and the four landing correction mechanisms in total correct the landing positions of electron beams. The landing correction mechanisms 7*a*, 7*b*, 7*c*, and 7*d* may be coils, for instance, that generate magnetic fields in such directions that landing deviations are corrected.

The processor 10 calculates an ambient temperature Te from an ambient temperature detection voltage Ve and a funnel temperature Tf from a funnel temperature detection voltage Vf. The processor 10 also calculates a temperature difference Tf−Te between the funnel temperature Tf and the ambient temperature Te, a temperature difference Te−Td between the ambient temperature Te and the landing design temperature Td, and a landing deviation amount (landing correction amount) G on the basis of these two temperature differences. The processor 10 outputs a voltage Vg according to the landing deviation amount G (landing correction voltage). The design temperature Td is an ambient temperature set when the landing characteristics are designed, for instance, and the value of the design temperature Td is stored in the processor 10 in advance.

The controller 11 controls the landing correction mechanisms 7*a*, 7*b*, 7*c*, and 7*d* in such a manner that the landing deviation amount G is corrected according to the landing correction voltage Vg. Correction currents I(a) , I(b) , I(c) , and I(d) for correcting the above-mentioned landing deviation amount G are supplied to the coils of the landing correction mechanisms 7*a*, 7*b*, 7*c*, and 7*d*, for instance.

Figure 2:
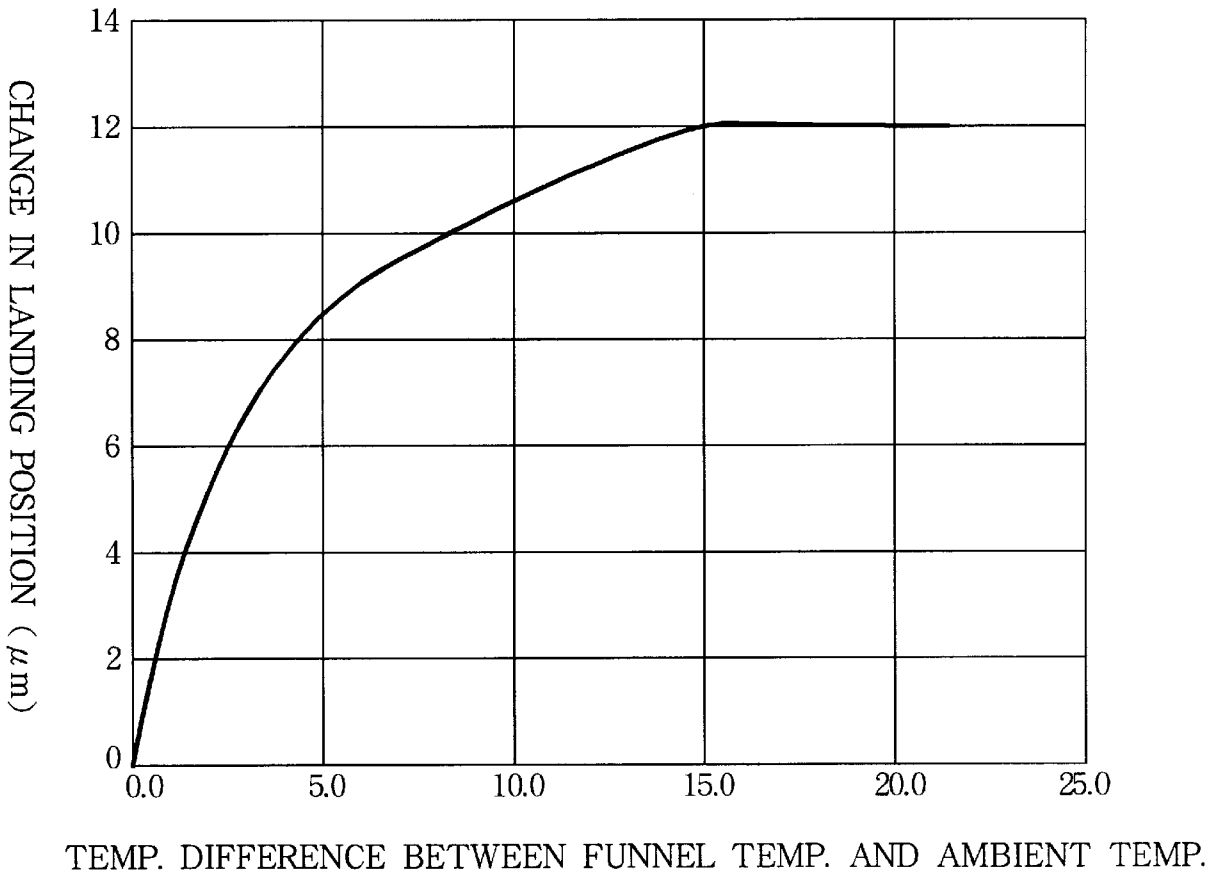
FIG. 2 is a diagram showing an amount of change in landing position, depending on the temperature difference between the funnel temperature and the ambient temperature.

When the color cathode ray tube operates, a temperature drift occurs, as explained above, and causes the landing positions of electron beams to vary. Meanwhile, the funnel temperature Tf also varies, accordingly changing the temperature difference Tf−Te between the funnel temperature Tf and the ambient temperature Te. There is a one-to-one relationship between the temperature difference Tf−Te obtained from the funnel temperature Tf and the ambient temperature Te and the amount of change in landing position, as shown in FIG. 2, for instance. FIG. 2 is a diagram showing an amount of change in landing position varying with the temperature difference between the funnel temperature and the ambient temperature. The characteristics shown in FIG. 2 are of a 17-inch cathode ray tube mounted in a monitor set.

If the ambient temperature Te differs from the design temperature Td, an environment drift occurs, as explained above, changing the landing positions of electron beams. The temperature difference Te−Td between the ambient temperature Te and the design temperature Td is proportional to the amount of change in landing position, and there is a one-to-one relationship between the two values. Usually, the amount of change in landing position is 1.0 $\mu$m/° C. in the range of 20° C.≦Te≦40° C. In the range of 0° C.≦Te≦20° C., the amount of change in landing position is 0.8 $\mu$m/° C.

The amount of change in landing position has one-to-one relationships with the temperature difference Tf−Te between the funnel temperature Tf and the ambient temperature Te and with the temperature difference Te−Td between the ambient temperature Te and the design temperature Td, as described above. Accordingly, if the amount of change in landing position corresponding to the temperature difference Tf−Te and the amount of change in landing position corresponding to the temperature difference Te−Td are known in advance, the amount of change in landing position (landing deviation amount) can be accurately calculated on the basis of the correspondence between the temperature difference and the amount of change in landing position when the temperature differences Tf−Te and Te−Td are calculated. Therefore, highly accurate landing correction can be performed by disposing the temperature sensors 8 and 9 in such positions that the amount of changes in landing position corresponding to the temperature differences Tf−Te and Te−Td are known, detecting the funnel temperature Tf and the ambient temperature Te by means of the temperature sensors 8 and 9, calculating the temperature differences Tf−Te and Te−Td, and controlling the landing correction mechanisms 7*a,* 7*b,* 7*c,* and 7*d* disposed in the corners of the color cathode ray tube according to the two temperature differences Tf−Te and Td−Te.

The landing correction method, which is performed the device of FIGS. 1A and 1B, is as follows. The temperature sensors 8 and 9 detect the ambient temperature Te and the funnel temperature Tf, respectively. The processor 10 calculates the temperature difference Tf−Te between the funnel temperature Tf and the ambient temperature Te, the temperature difference Te−Td between the detected ambient temperature Te and the design temperature Td stored in advance, and the landing deviation amount (landing correction amount) G based on those two temperature differences. The controller 11 controls the landing correction mechanisms 7*a,* 7*b,* 7*c,* and 7*d* according to the landing deviation amount G (controls the current flowing through the coils, for instance). The landing correction mechanisms 7*a,* 7*b,* 7*c,* and 7*d* correct the landing positions of electron beams (by generating magnetic fields that cancel out changes in landing position, for instance).

The details of the landing correction procedure will next be described. First, the ambient temperature sensor 8 generates the ambient temperature detection voltage Ve, and the ambient temperature detection voltage Ve is input to the processor 10. The funnel temperature sensor 9 generates the funnel temperature detection voltage Vf, and the funnel temperature detection voltage Vf is input to the processor 10.

Next, the processor 10 calculates the ambient temperature Te from the ambient temperature detection voltage Ve and the funnel temperature Tf from the funnel temperature detection voltage Vf. The processor 10 also calculates the temperature difference Tf−Te between the funnel temperature Tf and the ambient temperature Te and the temperature difference Te−Td between the detected ambient temperature Te and the landing design temperature Td stored in advance. Then, the processor 10 calculates the landing deviation amount G, based on the temperature differences Tf−Te and Te−Td, generates the landing correction voltage Vg corresponding to the landing deviation amount G, and inputs the landing correction voltage Vg to the controller 11.

Then, the controller 11 supplies the correction currents I(a), I(b), I(c), and I(d) for correcting the landing deviation amount G according to the landing correction voltage Vg, respectively to the landing correction mechanisms 7*a,* 7*b,* 7*c,* and 7*d.*

The landing correction mechanisms 7*a,* 7*b,* 7*c,* and 7*d* individually generate correction magnetic fields corresponding to the correction currents I(a), I(b), I(c), and I(d) supplied from the controller 11. Accordingly, the landing positions of electron beams are corrected, based on the temperature difference Tf−Te between the funnel temperature Tf and the ambient temperature Te and the temperature difference Td−Te between the landing design temperature Td and the ambient temperature Te.

As has been described above, the device of the first embodiment can correct landing deviations with high accuracy, by detecting the funnel temperature and the ambient temperature, separately calculating the temperature difference between the funnel temperature and the ambient temperature and the temperature difference between the ambient temperature and the design temperature, controlling the landing correction mechanisms according to these two temperature differences, and correcting the landing positions of electron beams. Because the brightness of the screen is not referenced in the first embodiment, even an extreme landing deviation as large as a single pitch can be corrected.

Second Embodiment

Figure 3A:
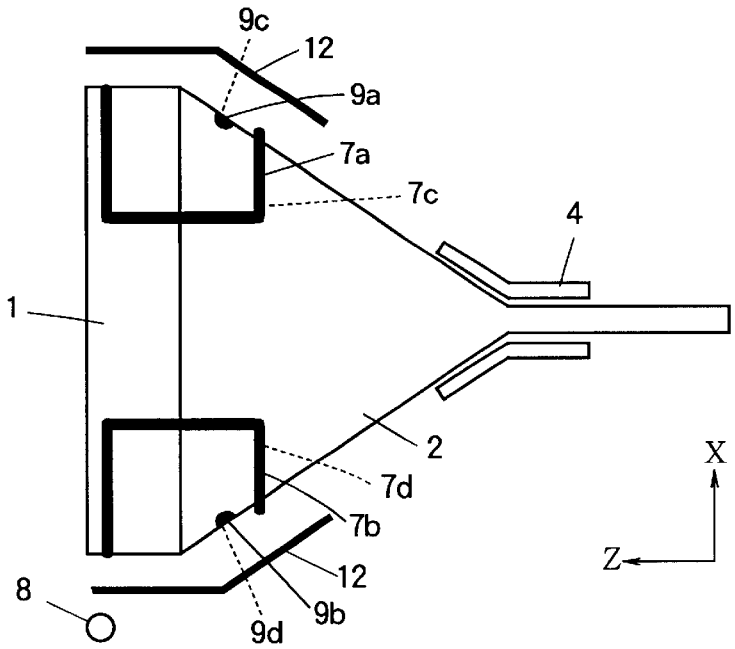
FIG. 3A is a diagram showing a plan view of a color cathode ray tube provided with a device for correcting a landing position according to a second embodiment of the present invention.
Figure 3B:
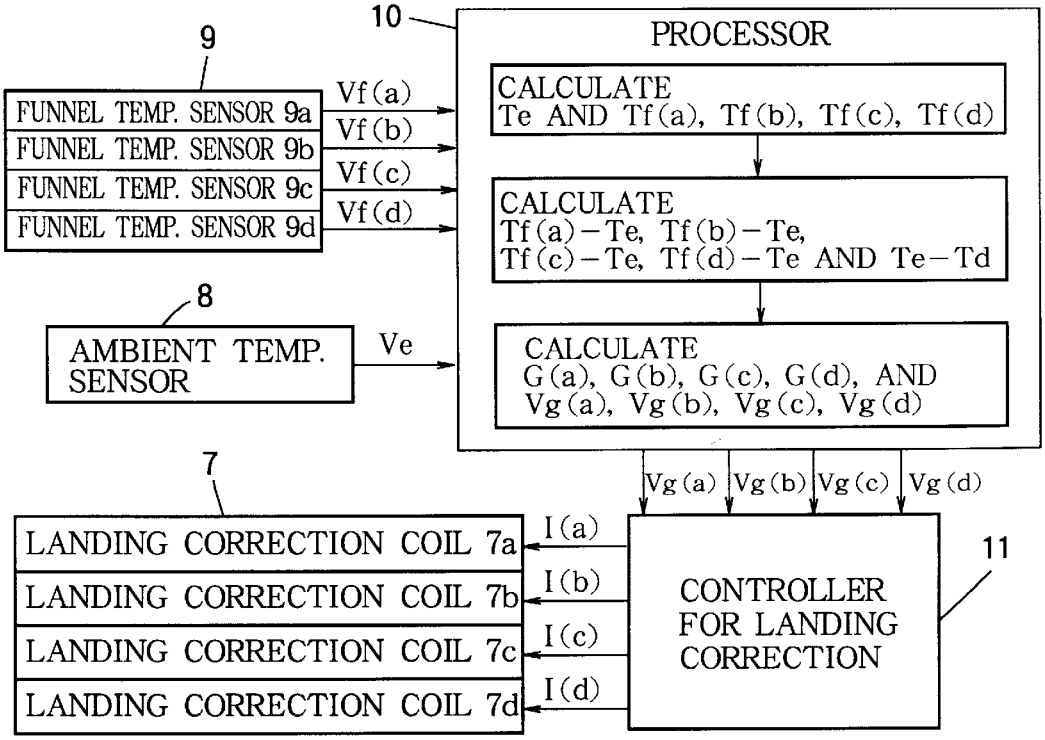
FIG. 3B is a block diagram showing the configuration of the device of the second embodiment.

FIG. 3A is a diagram showing a plan view of a color cathode ray tube provided with a device for correcting a landing position of an electron beam according to a second embodiment of the present invention. FIG. 3B is a block diagram showing the configuration of the device of for correcting a landing position. In the second embodiment, a single funnel temperature sensor 9 for detecting the funnel temperature is disposed in each of the four corners of the funnel 2, that is, four sensors (denoted by 9*a,* 9*b,* 9*c,* and 9*d*) in total are disposed. The temperature sensors 9*a,* 9*b,* 9*c,* and 9*d* separately sense the funnel temperatures Tf(a), Tf(b), Tf(c), and Tf(d) in the four corners. The landing correction mechanism 7*a* and funnel temperature sensor 9*a,* the landing correction mechanism 7*b* and funnel temperature sensor 9*b,* the landing correction mechanism 7*c* and funnel temperature sensor 9*c,* and the landing correction mechanism 7*d* and funnel temperature sensor 9*d* are disposed in those combinations in the corners.

In FIGS. 3A and 3B, the funnel temperature sensors 9*a,* 9*b,* 9*c,* and 9*d* output the funnel temperature detection voltages Vf(a), Vf(b), Vf(c), and Vf(d) respectively according to the funnel temperatures Tf(a), Tf(b), Tf(c), and Tf(d) in the four corners.

The processor 10 calculates the ambient temperature Te from the ambient temperature detection voltage Ve and the funnel temperatures Tf(a), Tf(b), Tf(c), and Tf(d) in the corners respectively from the funnel temperature detection voltages Vf(a), Vf(b), Vf(c), and Vf(d). The processor 10 separately calculates the temperature differences Tf(a)−Te), Tf(b)−Te, Tf(c)−Te, and Tf(d)−Te between the funnel temperatures Tf(a), Tf(b), Tf(c), and Tf(d) and the ambient temperature Te and the temperature difference Te−Td between the ambient temperature Te and the landing design temperature Td. Then, the processor 10 calculates the landing deviation amount G(a) according to the temperature differences Tf(a)−Te and Te−Td and generates the landing correction voltage Vg(a). The processor 10 also calculates the landing deviation amount G(b) according to the temperature differences Tf(b)−Te and Te−Td and generates the landing correction voltage Vg(b). The processor 10 further calculates the landing deviation amount G(c) according to the temperature differences Tf(c)−Te and Te−Td and generates the landing correction voltage Vg(c). The processor 10 also calculates the landing deviation amount G(d) according to the temperature differences Tf(d)−Te and Te−Td and generates the landing correction voltage Vg(d).

The controller 11 supplies the correction current I(a) to the landing correction mechanism 7*a* according to the landing correction voltage Vg(a), the correction current I(b) to the landing correction mechanism 7*b* according to the landing correction voltage Vg(b), the correction current I(c) to the landing correction mechanism 7*c* according to the landing correction voltage Vg(c), and the correction current I(d) to the landing correction mechanism 7*d* according to the landing correction voltage Vg(d).

Figure 4:
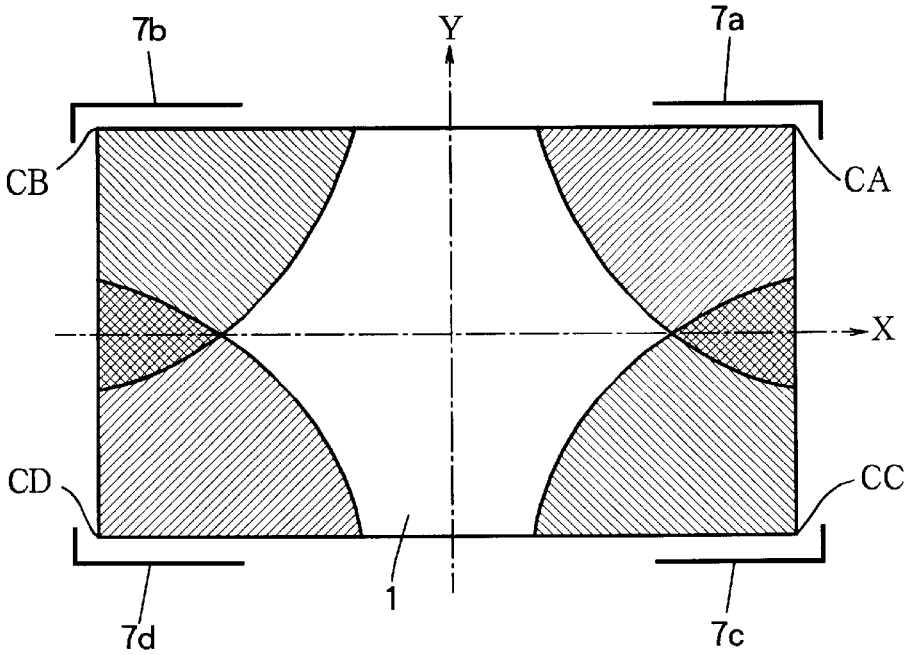
FIG. 4 is a diagram showing main correction ranges of landing correction mechanisms disposed on four corners of an outer surface of the color cathode ray tube.

If the temperature distribution of the funnel 2 is uneven, the amount of change in landing also varies from area to area in the glass panel 1. If this occurs, the landing correction amount must be changed according to the area in the glass panel 1. FIG. 4 is a diagram showing the main correction ranges of the landing correction mechanisms 7*a*, 7*b*, 7*c*, and 7*d* disposed in the four corners. As shown in FIG. 4, the main correction range of the landing correction mechanism 7*a* disposed in the corner CA is in the first quadrant in the XY plane (around the corner CA). Likewise, the main correction range of the landing correction mechanism 7*b* disposed in the corner CB is in the second quadrant (around the corner CB), the main correction range of the landing correction mechanism 7*c* disposed in the corner CC is in the fourth quadrant (around the corner CC), and the main correction range of the landing correction mechanism 7*d* disposed in the corner CD is in the third quadrant (around the corner CD). Accordingly, by disposing the temperature sensors 9*a*, 9*b*, 9*c*, and 9*d* in the four corners and controlling the landing correction mechanisms 7*a*, 7*b*, 7*c*, and 7*d* individually according to the temperature differences between the funnel temperatures in the four corners and the ambient temperature and the temperature difference between the ambient temperature and design temperature, landing deviations can be independently corrected in each quadrant in the glass panel 1, whereby further accurate landing correction can be performed.

The landing correction method, which is performed by the device of the second embodiment, is as follows. The temperature sensors 8 and the funnel temperature sensors 9*a*, 9*b*, 9*c*, and 9*d* detect the ambient temperature Te and the funnel temperatures Tf in each corner. The processor 10 calculates the temperature difference Tf−Te between the funnel temperature Tf in each corner and the ambient temperature Te, the temperature difference Te−Td between the detected ambient temperature Te and the design temperature Td stored in advance, and the landing deviation amount in each corner according to the temperature differences Tf−Te and Te−Td. The controller 11 separately controls the landing correction mechanisms 7*a*, 7*b*, 7*c*, and 7*d* according to the landing deviation amounts of the corresponding corners.

The landing correction procedure described above will next be described in details. First, the ambient temperature sensor 8 generates the ambient temperature detection voltage Ve and inputs the ambient temperature detection voltage Ve to the processor 10. The temperature sensors 9*a*, 9*b*, 9*c*, and 9*d* respectively generate the funnel temperature detection voltages Vf(a), Vf(b) , Vf(c), and Vf(d) and input these funnel temperature detection voltages to the processor 10.

Next, the processor 10 calculates the ambient temperature Te from the ambient temperature detection voltage Ve. The processor 10 also calculates the funnel temperatures Tf(a), Tf(b), Tf(c), and Tf(d) in the four corners from the funnel temperature detection voltages Vf(a), Vf(b), Vf(c), and Vf(d). Further, the processor 10 calculates the temperature differences Tf(a)−Te, Tf(b)−Te, Tf(c)−Te, and Tf(d)−Te between the funnel temperatures Tf(a), Tf(b) ,Tf(c), and Tf(d) and the ambient temperature Te. The processor 10 also calculates the temperature difference Te−Td between the detected ambient temperature Te and the landing design temperature Td stored in advance. Then, the processor 10 calculates the landing deviation amount around the corner CA (landing correction amount) G(a) according to the temperature differences Tf(a)−Te and Te−Td and generates the landing correction voltage Vg(a) according to the landing deviation amount G(a). Likewise, the processor 10 calculates the landing deviation amount G(b) around the corner CB according to the temperature differences Tf(b)−Te and Te−Td and generates the landing correction voltage Vg(b) accordingly. The processor 10 calculates the landing deviation amount G(c) around the corner CC according to the temperature differences Tf(c)−Te and Te−Td and generates the landing correction voltage Vg(c) accordingly. The processor 10 further calculates the landing deviation amount G(d) around the corner CD according to the temperature differences Tf(d)−Te and Te−Td and generates the landing correction voltage Vg(d) accordingly.

Next, the controller 11 provides the landing correction mechanism 7*a* in the corner CA with the correction current I(a) for correcting the landing deviation amount G(a) according to the landing correction voltage Vg(a). Likewise, the controller 11 provides the landing correction mechanism 7*b* in the corner CB with the correction current I(b) for correcting the landing deviation amount G(b) according to the landing correction voltage Vg(b). The controller 11 also provides the landing correction mechanism 7*c* in the corner CC with the correction current I(c) for correcting the landing deviation amount G(c) according to the landing correction voltage Vg(c). The controller 11 further provides the landing correction mechanism 7*d* in the corner CD with the correction current I(d) for correcting the landing deviation amount G(d) according to the landing correction voltage Vg(d).

The landing correction mechanisms 7*a*, 7*b*, 7*c*, and 7*d* generate correction magnetic fields respectively corresponding to the correction currents I(a), I(b), I(c), and I(d) from the controller 11. Accordingly, the landing positions of electron beams are corrected according to the temperature differences Tf(a)−Te, Tf(b)−Te, Tf(c)−Te, and Tf(d)−Te between the funnel temperature Tf and the ambient temperature Te and the temperature difference Td−Te between the landing design temperature Td and the ambient temperature Te.

As has been described above, the second embodiment can separately correct the landing in each quadrant in the glass panel 1 by detecting the funnel temperature in each corner and the ambient temperature, calculating the temperature difference between the funnel temperature in each corner and the ambient temperature, calculating the temperature difference between the ambient temperature and the design temperature, linking the temperature sensors 9 placed in the corners with the landing correction mechanisms 7 in the corresponding corners, and controlling the landing correction mechanism 7 of each corner according to the temperature difference between the funnel temperature in the corner and ambient temperature and the temperature difference between the ambient temperature and the design temperature. Therefore, landing deviations can be corrected with higher accuracy.

In the first embodiment described above, the funnel temperature sensor 9 placed in a corner is linked with the landing correction mechanism 7 provided in the same corner. For instance, the landing correction amount (correction current I(a)) by the landing correction mechanism 7*a* in the corner CA is determined on the basis of the temperature difference Tf(a)−Te between the funnel temperature in the corner CA and the ambient temperature and the temperature difference Te−Td between the ambient temperature and design temperature. The amounts of correction by the landing correction mechanisms 7*a,* 7*b,* 7*c,* and 7*d* in the four corners may also be determined independently of one another, according to the temperature differences Tf(a)−Te, Tf(b)−Te, Tf(c)−Te, and Tf(d)−Te between the funnel temperatures in the four corners and the ambient temperature and the temperature difference Te−Td between the ambient temperature and design temperature. For instance, the landing correction amount by the landing correction mechanism 7*a* in the corner CA may be determined mainly on the basis of the temperature differences Tf(a)−Te and Te−Td, with reference to the temperature differences Tf(b)−Te, Tf(c)−Te, and Tf(d)−Te.

The correction amounts by the landing correction mechanisms 7*a,* 7*b,* 7*c,* and 7*d* in the four corners may also be the same value determined by the temperature differences Tf(a)−Te, Tf(b)−Te, Tf(c)−Te, and Tf(d)−Te between the funnel temperatures in the four corners and the ambient temperature and the temperature difference Te−Td between the ambient temperature and design temperature. For instance, the landing correction amount by the landing correction mechanisms 7*a,* 7*b,* 7*c,* and 7*d* may be determined according to the average of the temperature differences Tf(a)−Te, Tf(b)−Te, Tf(c)−Te, and Tf(d)−Te between the funnel temperatures in the four corners and the ambient temperature and the temperature difference Te−Td.

Third Embodiment

Figure 5:
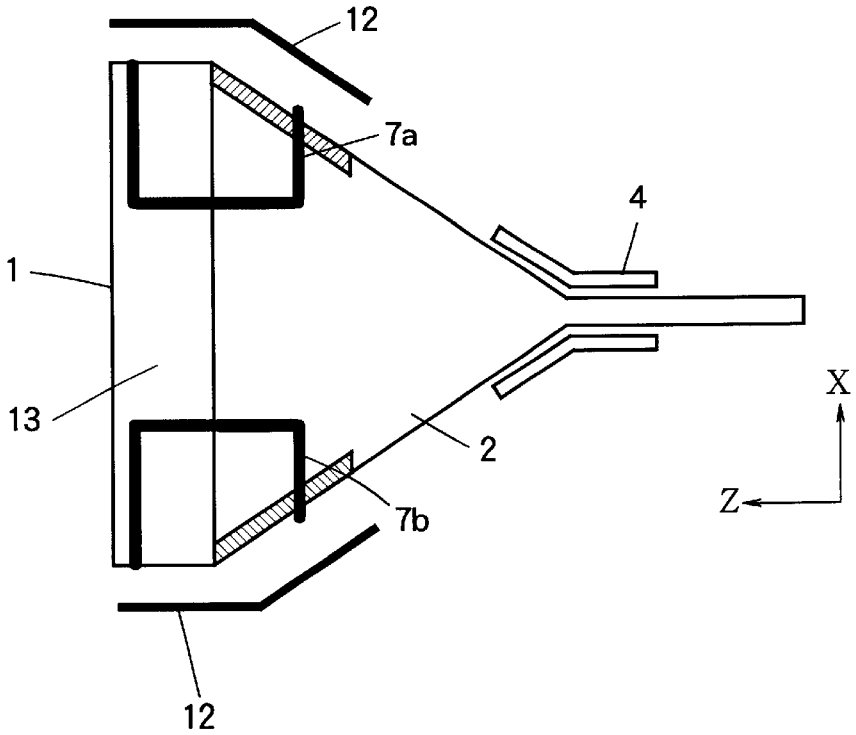
FIG. 5 is a diagram showing the mounting ranges of funnel temperature sensors in a color cathode ray tube according to a third embodiment of the present invention.

The funnel temperature sensors 9 for detecting the funnel temperature are disposed within the areas of the funnel 2 covered by the external magnetic shield 12, as depicted by hatched areas in FIG. 5. In the first and second embodiments, the funnel temperature sensors 9 (9*a,* 9*b,* 9*c,* and 9*d*) are disposed within those areas.

As described above, the third embodiment can accurately sense the funnel temperature under no influence of the heat generated by the deflection yoke 4, by disposing the temperature sensors 9 for detecting the funnel temperatures in the areas of the funnel 2 covered by the external magnetic shield 12. Changes in temperature of the funnel 2 affected by the heat remaining in between the external magnetic shield 12 and funnel 2 can be reflected in the detected temperature.

Fourth Embodiment

Figure 6A:
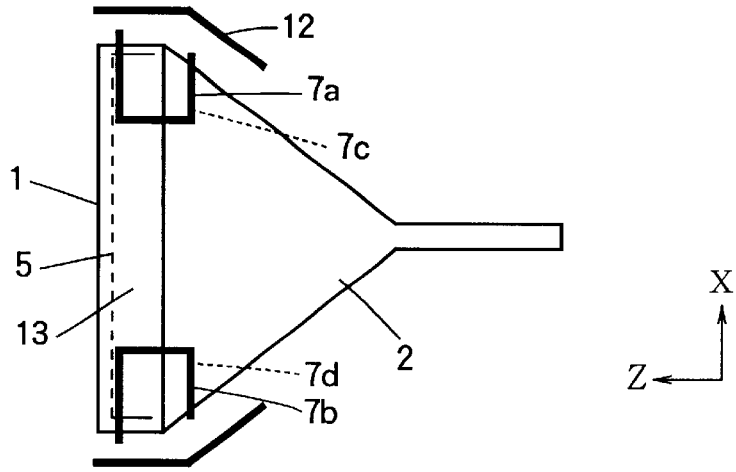
FIGS. 6A to 6C are diagrams showing the mounting positions of landing correction mechanisms in a color cathode ray tube according to a fourth embodiment of the present invention.
Figure 6B:
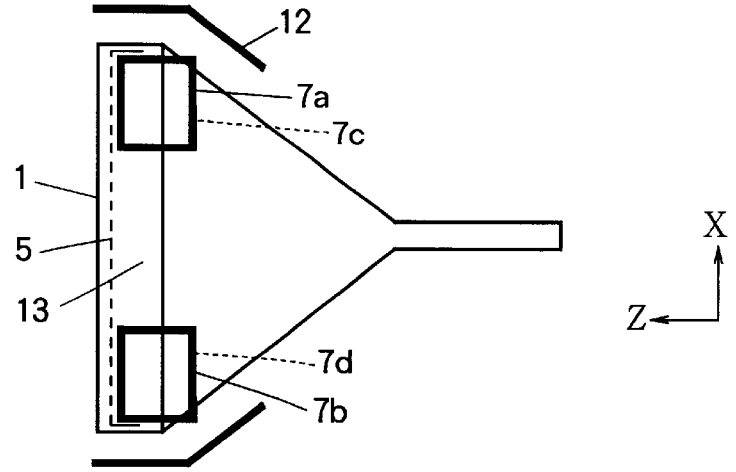
Figure 6C:
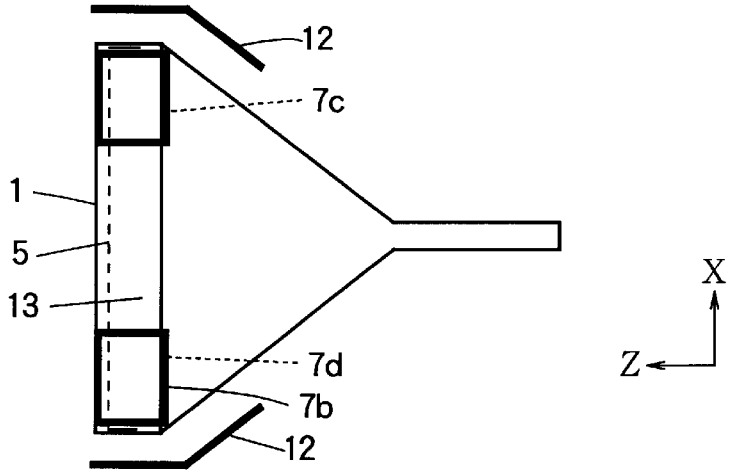

The landing correction mechanisms 7*a,* 7*b,* 7*c,* and 7*d* are disposed astride the panel skirt 13 and the funnel 2 of the glass panel 1, as shown in FIGS. 6A and 6B, or on the panel skirt 13, as shown in FIG. 6C, and generate magnetic fields in such directions that landing can be corrected. The landing correction mechanisms 7*a,* 7*b,* 7*c,* and 7*d* disposed as described above correct the courses of electron beams immediately before or after they pass the color selection member 5. In the first and second embodiments described above, the landing correction mechanisms 7*a,* 7*b,* 7*c,* and 7*d* are disposed as shown in FIG. 6A.

In FIG. 6A, the landing correction mechanisms 7*a,* 7*b,* 7*c,* and 7*d* are individually disposed astride the panel skirt 13 and the funnel 2 in the four corners in such a manner that they extend from the top or bottom face to the side face of the cathode ray tube (see FIG. 4). In FIG. 6B, the landing correction mechanisms 7*a,* 7*b,* 7*c,* and 7*d* are individually disposed astride the panel skirt 13 and the funnel 2 in the four corners on the top or bottom face of the cathode ray tube. In FIG. 6C, the landing correction mechanisms 7*a,* 7*b,* 7*c,* and 7*d* are individually disposed on the panel skirt 13 in the four corners on the top or bottom face of the cathode ray tube.

The device of the fourth embodiment can correct electron beams immediately before or after they pass the color selection member 5 by the landing correction mechanisms 7*a,* 7*b,* 7*c,* and 7*d* disposed astride the panel skirt 13 and the funnel 2 or on the panel skirt 13, so that landing deviations can be corrected with high efficiency and high accuracy.

Fifth Embodiment

The ambient temperature sensor 8 for detecting the ambient temperature is disposed below the front face of the color cathode ray tube, as shown in the side view of FIG. 7. The ambient temperature sensor 8 may also be disposed at the center or an end of the area below the front face. It is preferable that the ambient temperature sensor 8 is disposed in a place unsusceptible to the heat generated by the color cathode ray tube, a monitor circuit, and the like. The area below the front face of the color cathode ray tube is unsusceptible to the other temperatures.

The fifth embodiment can accurately sense the ambient temperature under no influence of the heat generated by the color cathode ray tube, a monitor circuit, and the like, by means of the ambient temperature sensor 8 disposed below the front face of the color cathode ray tube.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. A device for correcting a landing position of an electron beam in a color cathode ray tube, said device comprising:

a funnel temperature sensor for detecting a temperature of a funnel of the color cathode ray tube;

an ambient temperature sensor for detecting an ambient temperature around the color cathode ray tube;

a landing correction coil disposed on or around a corner of an outer surface of the color cathode ray tube; and a controlling section for calculating a first temperature difference between the temperature of the funnel and the ambient temperature and a second temperature difference between a predetermined design temperature and the ambient temperature, calculating a current value for said landing correction coil according to said first and second temperature differences, and supplying a current of the obtained current value to said landing correction coil.

2. The device of claim 1, wherein said landing correction coil is disposed on or around each of four corners of the outer surface of the color cathode ray tube.

3. The device of claim 1, wherein said funnel temperature sensor is disposed so as to be covered by an external magnetic shield disposed around the color cathode ray tube.

4. The device of claim 1, wherein said landing correction coil is disposed astride a panel skirt and the funnel of the color cathode ray tube.

5. The device of claim 1, wherein said landing correction coil is disposed on a panel skirt of the color cathode ray tube.

6. The device of claim 1, wherein said ambient temperature sensor is disposed below a face panel of the color cathode ray tube.

7. A device for correcting a landing position of an electron beam in a color cathode ray tube, said device comprising:

first to fourth funnel temperature sensors for detecting first to fourth temperatures of first to fourth corners of an outer surface of the color cathode ray tube, respectively;

an ambient temperature sensor for detecting an ambient temperature around the color cathode ray tube;

first to fourth landing correction coils disposed on or around the first to fourth corners of the outer surface of the color cathode ray tube, respectively;

a controlling section for calculating first to fourth temperature differences between the first to fourth temperatures and the ambient temperature, calculating a fifth temperature difference between a predetermined design temperature and the ambient temperature, calculating a first current value for said first landing correction coil according to said first and fifth temperature differences, calculating a second current value for said second landing correction coil according to said second and fifth temperature differences, calculating a third current value for said third landing correction coil according to said third and fifth temperature differences, calculating a fourth current value for said fourth landing correction coil according to said fourth and fifth temperature differences, and supplying first to fourth currents of the obtained first to fourth current values to said first to fourth landing correction coils, respectively.

8. The device of claim 7, wherein said first to fourth funnel temperature sensors are disposed so as to be covered by an external magnetic shield disposed around the color cathode ray tube.

9. The device of claim 7, wherein said first to fourth landing correction coils are disposed astride a panel skirt and the funnel of the color cathode ray tube.

10. The device of claim 7, wherein said first to fourth landing correction coils are disposed on a panel skirt of the color cathode ray tube.

11. The device of claim 7, wherein said landing correction coil is disposed on a panel skirt of the color cathode ray tube.

12. The device of claim 7, wherein said ambient temperature sensor is disposed below a face panel of the color cathode ray tube.

13. A method for correcting a landing position of an electron beam in a color cathode ray tube, said method comprising the steps of:

detecting a temperature of a funnel of the color cathode ray tube;

detecting an ambient temperature around the color cathode ray tube;

calculating a first temperature difference between the temperature of the funnel and the ambient temperature;

calculating a second temperature difference between a predetermined design temperature and the ambient temperature;

calculating a current value for a landing correction coil disposed on or around a corner of an outer surface of the color cathode ray tube according to said first and second temperature differences; and supplying a current of the obtained current value to said landing correction coil.

14. A method for correcting a landing position of an electron beam in a color cathode ray tube, said method comprising the steps of:

detecting a temperature of a funnel of the color cathode ray tube;

detecting an ambient temperature around the color cathode ray tube;

calculating a first temperature difference between the temperature of the funnel and the ambient temperature;

calculating a second temperature difference between a predetermined design temperature and the ambient temperature;

calculating four current values for four landing correction coils each disposed on or around corners of an outer surface of the color cathode ray tube according to said first and second temperature differences; and supplying currents of the obtained current values to said four landing correction coils, respectively.

15. A method for correcting a landing position of an electron beam in a color cathode ray tube, said method comprising the steps of:

detecting first to fourth temperatures of first to fourth corners of an outer surface of the color cathode ray tube;

detecting an ambient temperature around the color cathode ray tube;

calculating first to fourth temperature differences between the first to fourth temperatures and the ambient temperature;

calculating a fifth temperature difference between a predetermined design temperature and the ambient temperature;

calculating a first current value for a first landing correction coil disposed on or around the first corner according to said first and fifth temperature differences, a second current value for a second landing correction coil disposed on or around the second corner according to said second and fifth temperature differences, a third current value for a third landing correction coil disposed on or around the third corner according to said third and fifth temperature differences, and a fourth current value for fourth landing correction coil disposed on or around the fourth corner according to said fourth and fifth temperature differences; and supplying first to fourth currents of the obtained current values to said first to fourth landing correction coils, respectively.

* * * * *